US006418919B1

(12) United States Patent
Perrone

(10) Patent No.: US 6,418,919 B1
(45) Date of Patent: Jul. 16, 2002

(54) PAINTBALL LOADER WITH VIBRATING MECHANISM TO PREVENT JAMMING

(76) Inventor: Aldo Perrone, 7 Blue Jay Ave., Brampton, Ontario (CA), L6T 3Z8

( * ) Notice: Subject to any disclaimer, the term of this patent is extended or adjusted under 35 U.S.C. 154(b) by 0 days.

(21) Appl. No.: 09/766,160

(22) Filed: Jan. 19, 2001

(51) Int. Cl.[7] ..... F41B 11/02
(52) U.S. Cl. ..... 124/49; 221/200
(58) Field of Search ..... 124/49, 51.1, 73; 221/200

(56) References Cited

U.S. PATENT DOCUMENTS

| | | | |
|---|---|---|---|
| 1,403,719 | A | 1/1922 | Szepe |
| 3,348,531 | A | 10/1967 | Yano |
| 4,207,857 | A | 6/1980 | Balka, Jr. |
| 5,282,454 | A | 2/1994 | Bell et al. |
| 5,505,188 | A | 4/1996 | Williams |
| 5,542,570 | A | 8/1996 | Nottingham et al. |
| 5,722,383 | A | 3/1998 | Tippmann, Sr. et al. |
| 5,791,325 | A | 8/1998 | Anderson |
| 5,794,606 | A | 8/1998 | Deak |
| 5,816,232 | A | 10/1998 | Bell |
| 5,947,100 | A | 9/1999 | Anderson |
| 5,954,042 | A | 9/1999 | Harvey |

*Primary Examiner*—John A. Ricci
(74) *Attorney, Agent, or Firm*—Gifford, Krass, Groh, Sprinkle, Anderson & Citkowski, P.C.

(57) ABSTRACT

A bulk loader for supplying paintballs to a paintball gun including a loader housing for internally storing a quantity of paintballs, this housing having a bottom outlet through which paintballs can sequentially drop. A feed tube is connected to this housing at the outlet and extends downwardly therefrom. A paintball moving device which can take the form of a vibrator housing, is mounted in the loader housing and is capable of vibrating in order to move paintballs located near the bottom outlet. A vibrator, which can include a small electrical motor, causes the moving device to vibrate when a paintball jam must be freed up. Preferably the vibrator is mounted in the housing forming the moving device. A control mechanism controls the operation of the vibrator and includes a switch mounted in or adjacent to the feed tube for sensing the absence of a paintball within the feed tube. The vibrator can include a vibration causing weight that is mounted on the output shaft of the motor. The preferred switch comprises a magnetic switch.

21 Claims, 5 Drawing Sheets

PAINTBALL LOADER WITH VIBRATING MECHANISM TO PREVENT JAMMING

BACKGROUND OF THE INVENTION

This invention relates to bulk loaders for guns such as paintball guns and in particular to anti-jamming devices for use in these bulk loaders.

Games and training exercises played with paintballs and paintball guns have become very common in recent years and, as a result, a number of different types and models of paintball guns that employ pressurized gas to shoot paintballs have been designed and developed. The paintballs themselves comprise cylindrical capsules which have an outer layer made from gelatin usually and this outer layer encloses a colored liquid which generally has an oil base. When a player of a game or exercise is hit with one of these paintballs shot by another player's gun, the paintball ruptures easily and leaves a visible color mark on the player.

In recent years with the development of paintball guns capable of rapid firing, the use of bulk loaders attached to these guns has become common. These bulk loaders are capable of holding a relatively large number of these small paintballs. These known bulk loaders typically hold from 100 to 200 paintballs at a time and they are fitted with an aperture at one end for reloading more paintballs when they become emptied. During use of the gun, this aperture is covered with a removal cap which may be transparent. Generally speaking, these bulk loaders are mounted to one side of and above the breech section of the paintball gun. In this way use of the bulk loader does not interfere with the proper aiming of the gun and also the paintballs can be fed by gravity through a bottom outlet of the loader and to the infeed passage of the gun. The loader typically has a feed tube that is connected to the loader housing at its bottom outlet and this feed tube generally feeds paintballs sequentially to the infeed passage of the gun.

One commonly encountered problem with known bulk loaders of the past is that the paintballs can jam as they enter the feed tube during operation of the gun. A jam will, of course, prevent further paintballs from entering the feed tube causing the gun not to operate after several shots. Commonly, such jams have been cleared by simply shaking the gun manually in order to dislodge the paintballs at the entrance to the feed tube. This type of shaking is undesirable since it generally interferes with the operation of the gun and prevents proper aiming of the gun.

In recent years, there have been several proposals for anti-jamming devices to overcome the aforementioned problem. One known anti-jamming device is that taught in U.S. Pat. No. 5,282,454 issued Feb. 1, 1994 to C.M. Support, Inc. which describes and illustrates a bulk loader for a paintball gun. This known bulk loader employs an optical sensor to detect the absence of paintballs in the feed tube of a bulk loader and a rotatable agitator paddle member mounted in the housing that stores the paintballs. This paddle member can be rotated to clear a paintball feed jam by shifting paintballs located around the bottom outlet of the housing. There is an electric motor operated by a small battery that is able to rotate the paddle member when the absence of a paintball in the feed tube is sensed.

In applicant's co-pending U.S. patent application Ser. No. 09/434,428 filed Nov. 4, 1999 there is described a bulk loader for a paintball gun that employs an auger-like member rotatably mounted adjacent the bottom outlet of the paintball storing housing. Rotation of the auger-like member during use of the bulk loader acts to move paintballs in the region of the bottom outlet. An electric motor is operably connected to the auger-like member in order to rotate same and an electrical switch is mounted in the feed tube in order to sense the absence of a paintball within the feed tube.

It is an object of the present invention to provide an improved and an inexpensive jam clearing device for a projectile or paintball loading apparatus for a gun, this jam clearing device employing a vibrator which is capable of operating so as to move one or more projectiles without creating a jam at or near an outlet of the loading apparatus.

It is a further object of the present invention to provide a jam clearing device for a projectile loading apparatus which is reliable, relatively expensive to manufacture and use, and which has a control mechanism that includes an electrical circuit including a switch capable of turning the device on when a projectile or paintball jam in the loading apparatus needs to be cleared.

SUMMARY OF THE INVENTION

According to one aspect of the invention, a jam clearing device for a projectile loading apparatus for a gun includes a projectile moving device adapted for mounting in or on the loading apparatus, this device being capable of vibrating in order to move one more projectiles located at or near an outlet of the loading apparatus. There is also provided a vibrator for causing the moving device to vibrate, this vibrator being connected to the moving device, and a control mechanism for controlling the operation of the vibrator. The control mechanism includes an electric circuit having a sensor capable of turning the vibrator on when the sensor senses the need to operate the vibrating device to feed paintballs through the outlet of the loading apparatus. During use of the jam clearing device, the electrical circuit is able to turn the vibrator off when operation of the vibrator is not required.

In the preferred embodiment, the vibrator includes an electric motor having a rotatable output shaft and a vibration causing weight eccentrically mounted on the output shaft for rotation therewith.

According to another aspect of the invention, a bulk loader apparatus for supplying paintballs to a paintball gun comprises a loader housing for internally storing a quantity of paintballs, this loader housing having a bottom outlet through which stored paintballs can drop, and a feed tube connected to the loader housing at the bottom outlet and extending downwardly therefrom. The feed tube is connectible to the gun and is capable of sequentially delivering the paintballs to the gun. The apparatus also has a paintball moving device mounted in or on the loader housing and capable of vibrating in order to move one or more paintballs located at or near the bottom outlet. A vibrator causes the moving device to vibrate and this vibrator is connected to the moving device. A control mechanism is provided to control the operation of the vibrator and this mechanism includes a switch mounted in or adjacent to the feed tube for sensing the absence of a paintball within the feed tube at the location of the switch. The control mechanism operates the vibrator to vibrate the moving device and thus cause one or more paintballs to drop into the feed tube when the switch senses the absence of a paintball.

In a preferred embodiment, the paintball moving device is a vibrator housing enclosing the vibrator and a spring connected to the vibrator housing at one end thereof and connected to a top wall of the loader housing at an opposite end thereof.

According to a further aspect of the invention, a portable paintball gun apparatus comprises a paintball gun having an intake passage for sequentially receiving paintballs to be shot from the gun and a loader housing for receiving and storing a quantity of paintballs and mounted generally above the gun. The loader housing has a bottom outlet through which stored paintballs can pass generally one after another. A feed tube is attached to both the loader housing at the bottom outlet and to the gun at the intake passage and this feed tube is adapted to receive and hold paintballs delivered from the housing for a gravity feed to the gun. A vibrating device is mounted in the loader housing and is capable of vibrating in order to move one or more paintballs located at or near the bottom outlet. There is also a control mechanism for controlling the operation of the vibrator, this control mechanism including an electrical circuit having a sensor capable of controlling flow of current in the electrical circuit. The sensor senses the need to operate the vibrating device to provide paintballs to the feed tube.

The preferred vibrating device in this paintball gun includes an electric motor having a rotatable output shaft and a vibration causing weight eccentrically mounted on the output shaft for rotation therewith.

Further features and advantages of the jam clearing device, the bulk loader apparatus and the paintball gun of this invention will become apparent form the following detailed description thereof taken on conjunction with the accompany drawings.

DETAILED DESCRIPTION OF PREFERRED EMBODIMENT

Figure 1:
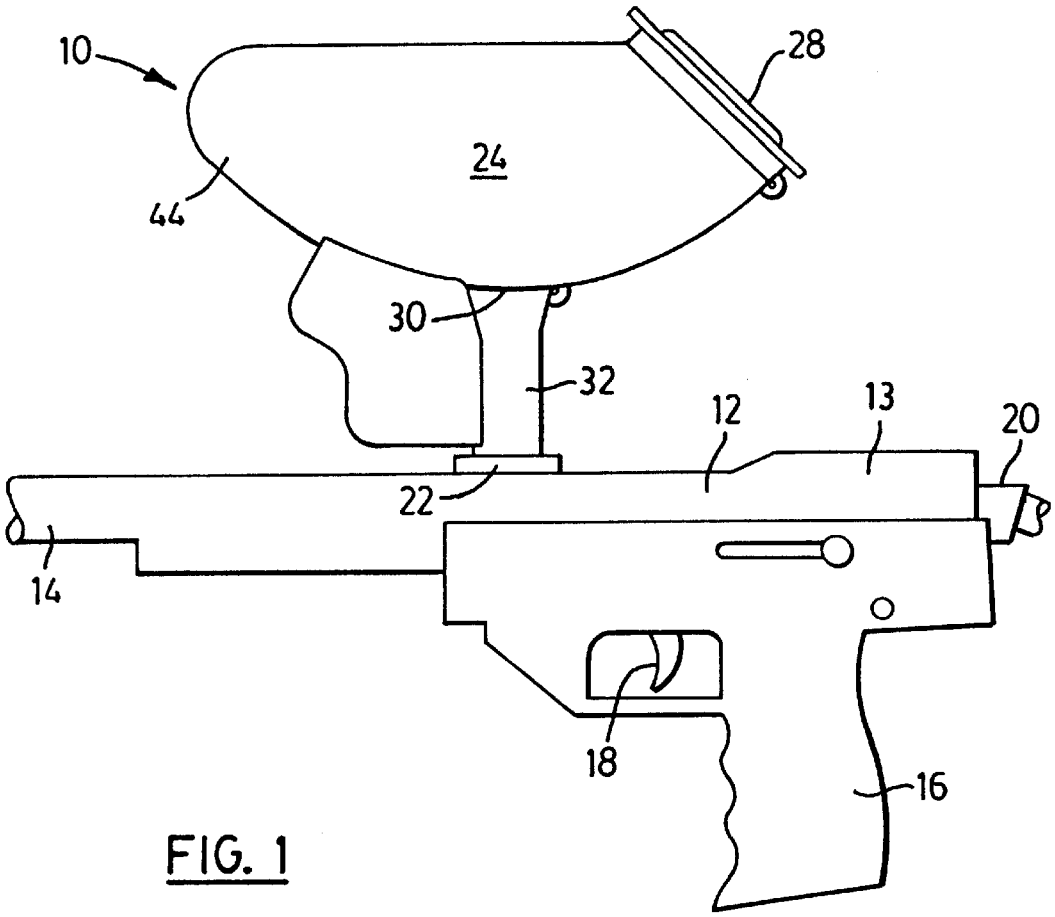
FIG. 1 is a side view of a bulk loader constructed in accordance with the invention mounted on a semi-automatic paintball gun, portions of which have been omitted for ease of illustration.

FIG. 1 illustrates an improved bulk loader apparatus 10 constructed in accordance with the invention mounted on a conventional paintball gun 12, front and rear portions of which have been omitted for ease of illustration. The gun can be of a semi-automatic firing type having the main body 13, a forwardly extending barrel 14, a hand grip 16 and a trigger 18. Other types of paintball guns can also employ the bulk loader of the invention. For example, the gun can be a pump action gun rather than semi-automatic. It will be understood that there can be connected to the rear end of the gun or at the bottom of the hand grip 16 a $CO_2$ pressurized gas cannister that normally extends rearwardly. In the illustrated gun this cannister is connected to a canister connector at 20.

In a known manner, the gun 12 is fitted with a tubular elbow at 22 for the purpose of feeding standard paintballs to the firing chamber of the gun. The elbow 22 has an open top end to which the apparatus 10 can be detachably connected. It will be understood that paintballs stored within a housing 24 of the apparatus 10 are fed by gravity downwardly into the gun for firing by pressurized gas from the canister. With semi-automatic fire a paintball is fired with each pull of the trigger 18. Automatic fire is also possible with many guns. The housing 24 is typically made from polypropylene or polyethylene plastic and is typically made of two half sections that are joined at the center of the housing.

The preferred illustrated housing 24 can store a substantial quantity of standard paintballs, for example 100 to 200 and it is provided with a relatively large opening at 26 through which the paintballs can be poured into the housing by the user of the gun. As illustrated, this opening is located at the rear end of the housing and it is arranged at an angle to be horizontal. After the paintballs have been placed in the housing, the opening 26 can be covered with a suitable plastic cap 28 shown in FIG. 1. In the preferred embodiment, this cap is made of a transparent material so that the balls in the housing can be readily viewed by the user of the gun. The cap 28 can either be made completely detachable (as in the version of FIG. 1) or it can be hinged to the housing 24 by means of a pin extending through or from one or two connecting lugs 40, one of which can be seen in FIG. 2.

Figure 4:
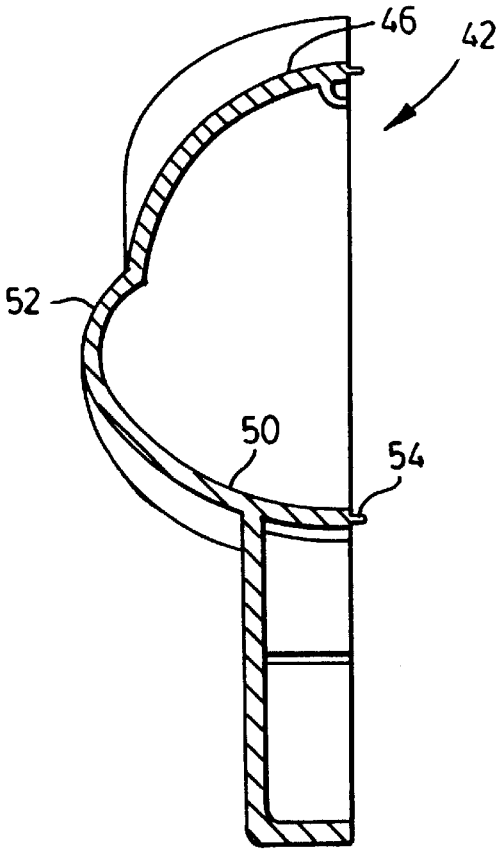
FIG. 4 is a cross-sectional elevation of the left section of the housing, this cross-section being taken along the line IV—IV of FIG. 2.
Figure 5:
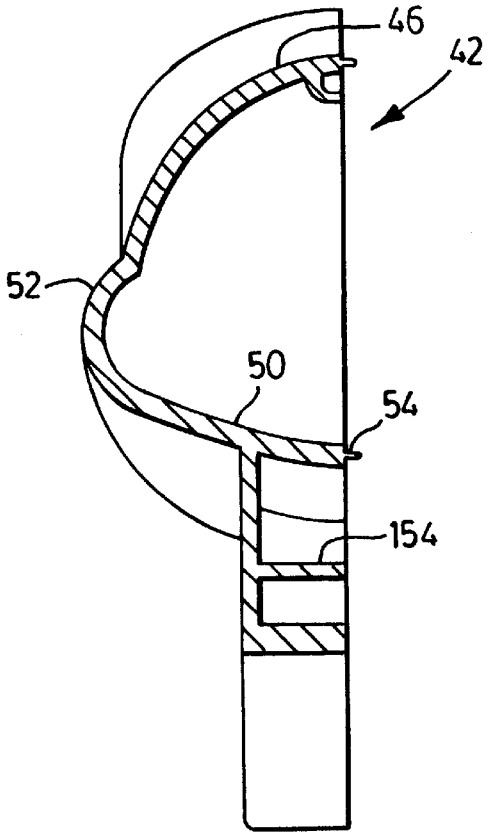
FIG. 5 is another cross-sectional elevation showing the left section of the loader housing, this cross-section being taken along the line V—V of FIG. 2.

The housing has a bottom outlet located at 30 through which stored paintballs can drop sequentially into a vertically extending feed tube 32. The bottom of the housing can be rounded as illustrated with the bottom section of the walls sloping towards the bottom outlet 30. If the housing 24 is made from molded plastic, as is preferred, it should be sufficiently strong to resist breakage. The illustrated housing is made from two half sections which can be of similar construction with the left half section 42 being illustrated in FIGS. 2 to 5 and the right half section 44 being shown in FIG. 1. As these two half sections are of similar construction, only the left hand section will be described herein in detail. The illustrated half section has a top wall at 46 and a rounded front end at 48. Each half section also has a sloping bottom 50 which is sloped so as to feed paintballs towards the bottom outlet 30. As illustrated in FIGS. 4 and 5, not only does the bottom slope downwardly from the front and rear ends of the bulk loader, but it also slopes downwardly from a rounded side wall 52. Preferably the two half sections are joined by means of a tongue and groove type connection in order to form a snug and completely closed joint between the two half sections. In the illustrated embodiment, the left half section 42 has a short tongue 54 that extends along the entire edge of the half section. It will be understood that the right half section has an elongate groove (not shown) that snugly accommodates the tongue 54. The two half sections are also joined together by means of suitable bolts or screws that extend through integral, plastic connecting lugs located at 55 to 59 of the left half section. The connecting lugs 56 to 58 project outwardly from an adjacent wall of the half section. There can also be an internal, integral plastic front connector 60 formed in each half section with the two connectors 60 being joined by means of a pin. Another hole for a connecting screw or bolt can be formed near the lug 40 and above the opening 26 at 62.

Figure 2:
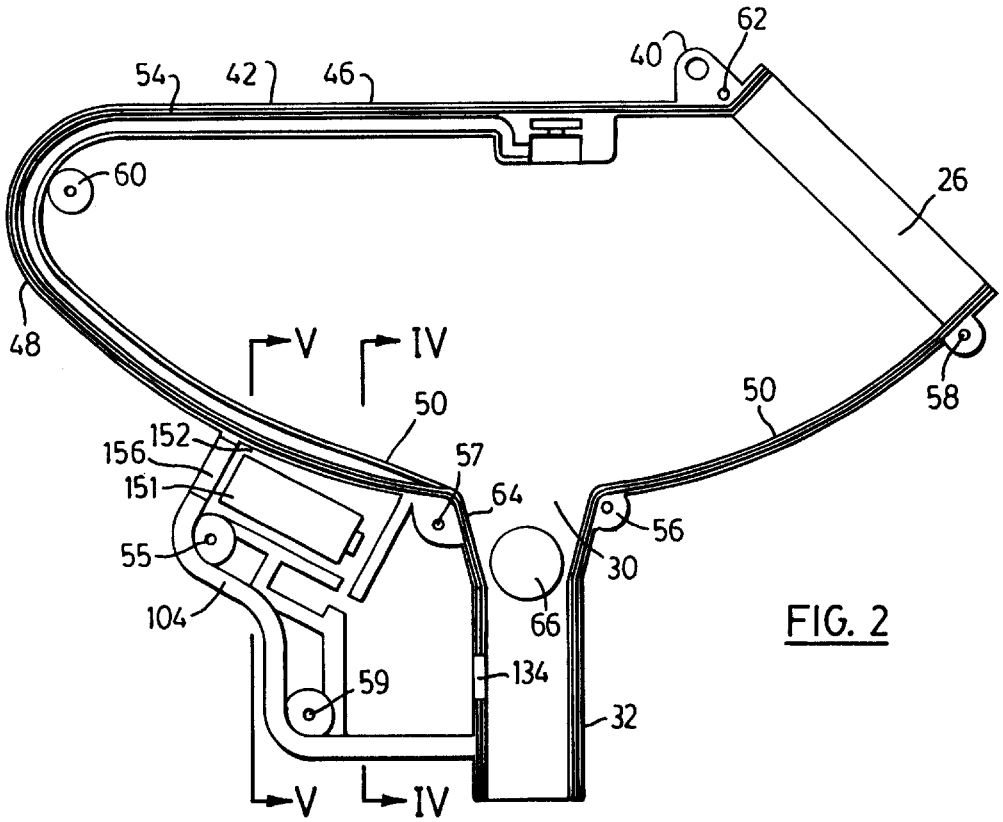
FIG. 2 is a side elevation of a left half section of a loader housing used in the bulk loader of FIG. 1.
Figure 3:
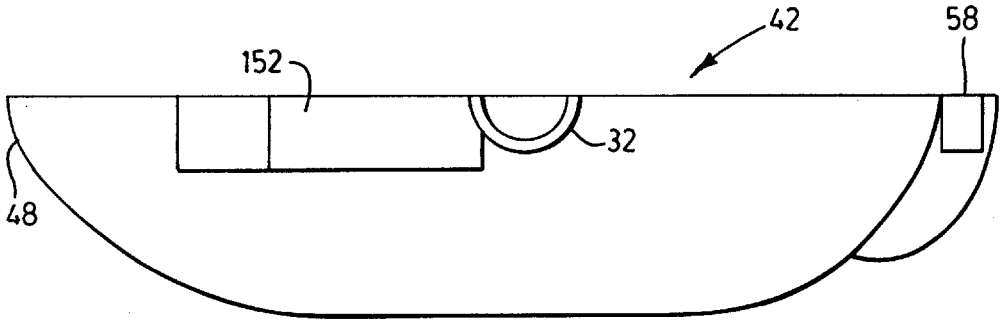
FIG. 3 is a bottom view of the left half section of the loader housing of FIG. 2.

Preferably the feed tube 32 is an integral extension of the loader housing as illustrated in FIG. 2. The upper end section 64 of the feed tube can be conical so as to taper inwardly in the downwards direction. This helps to feed paintballs 66 in a sequential manner into the feed tube. The main lower section of the feed tube can be cylindrical and can be a straight, vertical section. The diameter of the cylindrical lower portion of the feed tube is only slightly larger than the diameter of a standard paintball 66.

It will be understood that the open lower end section of the feed tube 32 extends into an upper end section of the aforementioned elbow 22 and is detachably connected thereto. It should be noted that although a side feed arrangement for the gun is illustrated in FIG. 1, the present bulk loader can also be used in the known vertical feed arrangement for a paintball gun.

Figure 6:
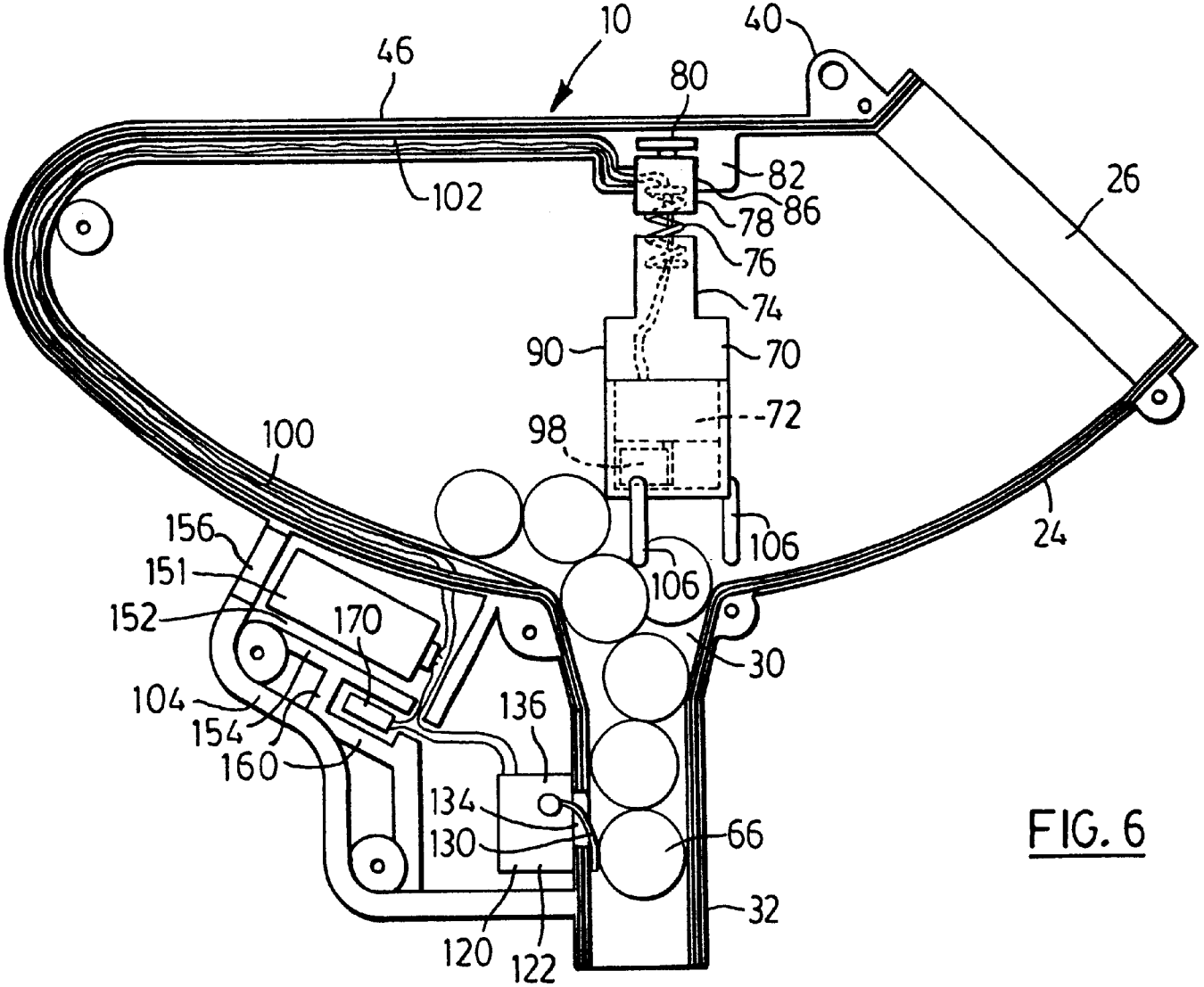
FIG. 6 is a longitudinal cross-sectional elevation of the bulk loader fitted with a jam clearing device constructed in accordance with the invention.

Turning to FIG. 6, it is possible for paintballs located around the bottom outlet to create a jam at the entrance to the feed tube so that paintballs no longer drop into the feed tube. This may be due in part to the gelatin exterior of the paintballs. If this occurs, the stack or row of paintballs in the feed tube can quickly be depleted, particularly when the gun is being fired rapidly. With a conventional bulk loader that has no jam freeing mechanism, it may become necessary to manually shake the gun and the loader to dislodge the jam and produce another row of paintballs within the feed tube.

In order to prevent such a jam from occurring and to move paintballs at the bottom outlet, the bulk loader 10 of the invention is provided with a paintball moving device 70 mounted in the loader housing 24 as illustrated in FIG. 6. This paintball moving device is capable of vibrating in order to move one or more paintballs located at or near the bottom outlet 30. The jam clearing device includes as well a vibrator for causing the moving device 70 to vibrate. This vibrator is indicated generally by reference 72 in FIG. 6 and preferably is connected to the moving device 70 so that it will transfer its vibrations to the moving device. Preferably the paintball moving device is a vibrator housing which can be made of a suitable, durable plastic and which can be round in transverse cross-section. As illustrated in FIG. 6, the vibrator housing encloses the vibrator 72 within a lower portion thereof. The vibrator housing has an upper section 74 of reduced diameter and connected to this upper section is a spring 76 which preferably is a coil spring. As illustrated, one end section of the spring extends into the upper section 74 of the housing and thus the spring is connected at one end thereof to the housing. An upper portion of the spring 76 extends into a mounting bracket or spring holder 78 which is formed with an upper connecting section 80. The bracket 78 connects the top end of the spring to the top wall 46 of the loader housing. In order to mount the bracket 78, the top wall can be formed with a thicker wall section at 82 and formed within this section is a round recess into which the connecting section 80 is snugly received. In order to provide further support for the bracket 78, there can be a round recess at 86 into which an upper portion of the bracket is snugly received. The bracket 78 can have a round exterior and can be formed with a cylindrical cavity (not shown) to accommodate the upper portion of the spring. It will be understood that springs other than coil springs could also be used to mount the paintball moving device, for example a flat spring or a leaf spring that extends downwardly to the moving device 70 could also be used.

Although the illustrated moving device or motor housing 70 is shown connected to the top wall of the loader housing 24, it is also possible to connect the moving device 70 to a sidewall or the bottom of the housing 24 as long as it is located close enough to the bottom outlet to prevent paintball jams at the outlet.

The preferred illustrated moving device includes a main body 90 forming an upper portion of the housing and a housing cover section 92. The cover section can be attached to the main body 90 in several possible ways including a threaded connection with, for example internal threads being formed within the cover to engage external threads on a lower end portion of the main body. A snap fit is also possible but the joint between the two members must be sufficiently secure so that the cover section 92 cannot accidentally detach from the main body 90 when the device is vibrating.

Figure 9:
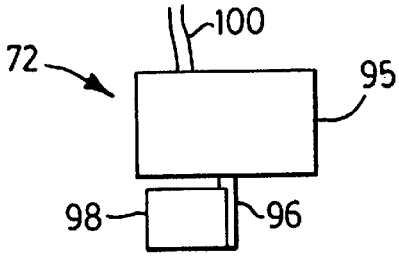
FIG. 9 is a side elevation of a small electric motor and eccentric weight used to make the vibrator of the jam clearing device.

The aforementioned vibrator 72 preferably comprises an electric motor 95 which can be cylindrical on its exterior to fit snugly within the cylindrical cavity formed in the vibrator housing. The motor has a rotating output shaft 96 (see FIG. 9) extending downwardly therefrom and a vibration causing weight 98 is eccentrically mounted on the output shaft 96 for rotation therewith. Extending upwardly from the top end of the motor 95 are a pair of wires 100, only end portions of which are shown in FIG. 9. It will be understood that these wires extend upwardly through the vibrator housing, through the upper section 74 and the center of the coil spring and up through the bracket 78. The two wires 100 extend along a suitable groove formed in the wall of the loader housing, this groove being shown at 102. The groove 102 extends forwardly from the thicker wall section 82, around the front end of the loader and down to a battery housing section 104. It will be understood that the wires 100 form part of an electrical circuit that is used to operate and control the operation of the vibrator. Groove 102 can be formed in either of the two half sections 42,44 or it can be formed partially in one half section and partially in the other half section. When the two half sections are joined together in order to complete the loader housing, the groove 102 with the wires 100 therein is completely enclosed so that the wires are securely held in place and protected.

For improved engagement of the vibrator housing with the paintballs located in the vicinity of the outlet 30, the cover section 92 of the vibrator housing can have two, three or more prongs extending downwardly therefrom, these prongs being indicated at 106 in FIG. 6. As illustrated, these prongs are located close to the bottom outlet 30 of the loader housing. The preferred illustrated vibrator housing of FIG. 6 includes a cylindrical section that can be formed by a combination of the aforementioned main body 90 and the cover section 92. This cylindrical section has a vertically extending central axis in the preferred jam freeing device and the spaced apart prongs 106 extend downwardly from this cylindrical section. Although the prongs can be made of metal, they are preferably made of a suitably strong plastic and they can be an integral extension of the vibrator housing.

A control mechanism is provided for controlling the operation of the vibrator 72 and this control mechanism is indicated generally at 120 in FIG. 6. The control mechanism includes a switch, which can be a microswitch or preferably a magnetic switch, and this switch 122 is mounted in or adjacent to the feed tube 32 for sensing the absence of a paintball 66 within the feed tube at the location of the switch. It will be understood that the control mechanism 120 operates the vibrator to vibrate the moving device 70 and thus cause one or more paintballs to drop into the feed tube when the switch senses the absence of a paintball.

The switch or sensor 122 illustrated in FIG. 6 is a microswitch having a switch operating member 130 that extends into the feed tube in the absence of a paintball in the feed tube means. It will be understood that there is an aperture 134 formed in the front side of the feed tube and through which the operating member 130 extends. The body 136 of the microswitch can be affixed to the exterior of the feed tube and located within the housing section 104.

Figure 7:
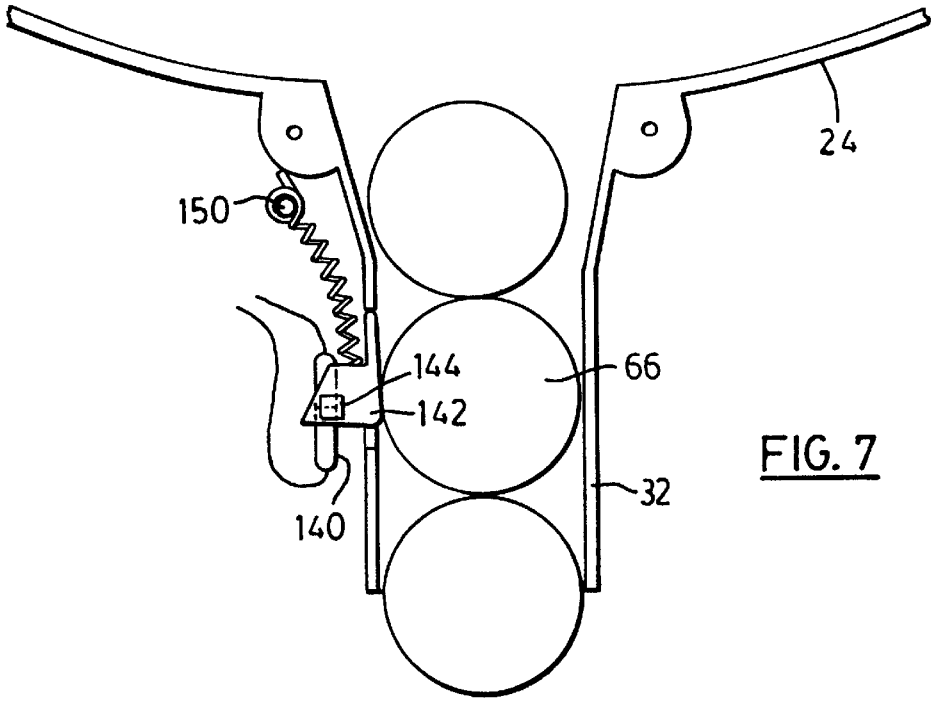
FIG. 7 is a schematic cross-sectional detail illustrating the open position of a magnetic switch used in the control mechanism for the jam clearing device.
Figure 8:
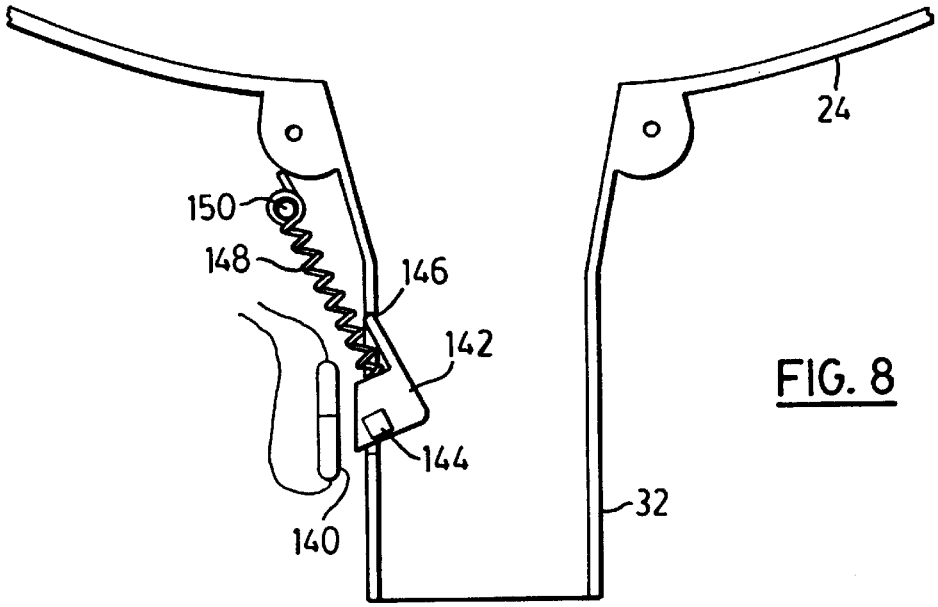
FIG. 8 is a schematic cross-sectional detail drawing the switch of FIG. 7 in the closed position where a switch operating member extends into the feed tube.

A preferred form of switch or sensor for the present bulk loader and its jam freeing mechanism is a magnetic switch 140 illustrated in FIGS. 7 and 8. This switch also has a switch operating member 142 that extends into the feed tube 32 through a suitable opening formed in the side of the feed tube. A small permanent magnet 144 can be mounted in the operating member. The operating member is mounted on a coil spring 148 which can be used to bias the switch operating member 142 towards a position where it extends into the feed tube as shown in FIG. 8. The preferred illustrated spring is the coil spring 148 having an upper end which is attached to the housing by a pin at 150. The spring does not compress or rotate substantially but rather bends as shown in FIG. 7 when the operating member 142 is pushed inwardly by the presence of a paintball 66. This spring mounting requires very little pressure from the adjacent paintball to move the operating member 142 inwardly. The magnetic switch that is used can be either a normally open switch or it can be a normally closed switch with the illustrated switch 140 being a normally closed switch. Thus in the situation illustrated in FIG. 7 where there are paintballs 66 present in the feed tube, the adjacent paintball presses the operating member 142 with its magnet 144 to a position where it is closely adjacent the magnetic switch 140. This causes the switch to move to the open position at which the flow of power to the electric motor is cut off and thus the jam freeing device is not operational. However if there is an absence of paintballs in the feed tube as illustrated in FIG. 8, the switch operating member 142 is forced by the coil spring to the illustrated position where it extends into the feed tube. In this position, the magnet is located away from the magnetic switch 140 and therefore the magnetic switch is closed. In this position of the magnetic switch, the electrical circuit is closed and power flows from the battery to the electric motor causing the vibrator 72 to operate.

It will be understood that in the alternate version where the magnetic switch 140 is a normally open switch, if the permanent magnet is moved to the position away from the magnetic switch, then the magnetic switch is in the closed position which will cause the electric motor to run or operate. However if there are paintballs in the feed tube and the magnet is pushed to a position close to the magnetic switch, this will cause this type of magnetic switch to be open causing the electrical motor in turn to stop running.

One or two standard DC batteries such as a 9V battery indicated at 151 can be mounted in a battery compartment 152 illustrated in part in FIG. 2. The battery compartment is formed with a bottom 154, one half of which can be seen in FIG. 5. There is an opening formed in the front end of the compartment at 156 to permit removal of an old battery and insertion of a new battery and it will be understood that this opening will normally be covered by a suitable battery cover mountable in the opening. The battery 151 is electrically connected to the switch 122 or 140 and also to the electric motor via the aforementioned wires 100 and the battery is capable of powering the vibrator. In the preferred illustrated version of the battery compartment, this compartment is integrally attached to the outer housing and is located forwardly of the feed tube. If desired, inner walls or ridges 160 can be formed within the housing section 104 and these will help to divide and strengthen this section of the loader housing.

Figure 10:
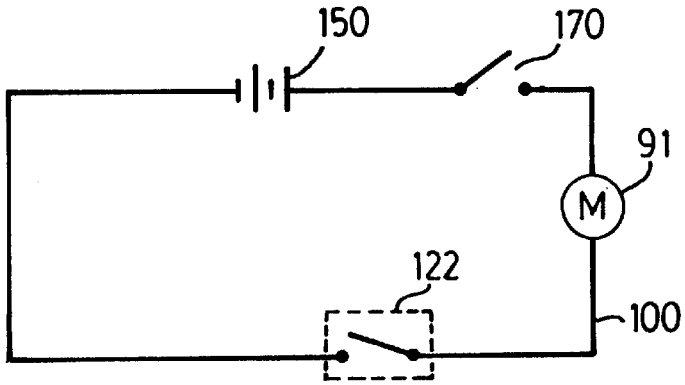
FIG. 10 is a schematic diagram of a DC electrical circuit that can be used in the bulk loader apparatus.

FIG. 10 is a schematic diagram of a DC electrical circuit that can be utilized in this bulk loader to operate the jam frame mechanism. The control switch 122 is connected via the wires 100 to both a terminal of the battery 150 and to the electric motor 91. Also illustrated in this schematic diagram is a preferred, manual on/off switch 170 which can, for example, be mounted on one side of the housing section 104. Thus the operation of the jam freeing device can be activated or deactivated by the gun user by means of the switch 170.

Instead of a sensor or switch such as a microswitch or the aforementioned magnetic switch 140, it is also possible to control the operation of the jam freeing device by means of a sound sensor such as that described in U.S. Pat. No. 5,947,100 issued Sep. 7, 1999 to J. A. Anderson, the specification and drawings of which are incorporated herein by reference. The controller described in this patent has a firing sensor which uses pressure variations transmitted through a medium to sense the firing of the gun, and in response thereto, generate an electrical firing signal. There is also means for prolonging this signal to produce a signal indicating a demand for paintballs which is of longer duration than the firing event. The controller is then able to activate the paintball agitator motor responsive to the paintball demand signal. It will be appreciated that with this type of controller or sensor, the actual presence or absence of a paintball is not sensed and therefore the sensor is not sensing whether or not a paintball jam actually exists but is simply sensing a need or possible need to operate the vibrating device to provide paintballs to the feed tube. This type of sensor can also be used in the bulk loader of the invention if desired. In a similar way, it is also possible to sense the shock created by firing a gun (as opposed to the noise) and thereby trigger the operation of the jam freeing device.

Another possible sensor or switch that can be used in the anti-jamming device of this invention is that illustrated and described in the aforementioned U.S. Pat. No. 5,282,454 issued in 1994. In this known bulk loader there is an optical sensor to detect the absence of paintballs in the feed tube. This type of sensor can also be used to generate an electrical signal or to close an electrical circuit and thereby cause the vibrating device to operate.

It will be appreciated by those skilled in the art that the described embodiments for clearing paintball jams are relatively inexpensive to build while at the same time they can be made quite reliable and easy to use. The vibrations caused by the vibrator are not so severe as to interfere with the operation and use of the paintball gun and it will be appreciated that these vibrations only occur when the paintball jam exists and not when paintballs are dropping in a normal manner through the feed tube.

It will be further appreciated that various modifications and changes can be made to the bulk loader and to the jam clearing device of this invention without departing from the spirit and scope of this invention. For example it is possible to mount the vibrator device on the exterior of the housing storing the paintballs rather than inside the housing. It is simply necessary for the vibrator to be able to vibrate or shake the paintballs within the housing sufficiently to effectively prevent most or all paintballs jams.

What is claimed is:

1. A bulk loader apparatus for supplying paintballs to a paintball gun comprising:

a loader housing for internally storing a quantity of paintballs, said loader housing having a bottom outlet through which stored paintballs can drop;

feed tube means connected to said loader housing at said bottom outlet and extending downwardly therefrom, said feed tube means being connectible to said gun and capable of sequentially delivering the paintballs to the gun;

a paintball moving device mounted in or on said loader housing and capable of vibrating in order to move one or more paintballs located at or near said bottom outlet;

a vibrator for causing said moving device to vibrate, said vibrator being connected to said moving device; and a control mechanism for controlling the operation of said vibrator, said control mechanism including a switch mounted in or adjacent to said feed tube means for sensing the absence of a paintball within said feed tube means at the location of said switch;

wherein said control mechanism operates said vibrator to vibrate the moving device and thus cause one or more paintballs to drop into said feed tube means where said switch senses the absence of a paintball.

2. A bulk loader apparatus according to claim 1 wherein said paintball moving device is a vibrator housing enclosing said vibrator and a spring connected to said vibrator housing at one end thereof and connected to a top wall of said loader housing at an opposite end thereof.

3. A bulk loader apparatus according to claim 2 wherein said switch is a microswitch having a switch operated member that extends into said feed tube means in the absence of a paintball in said feed tube means.

4. A bulk loader apparatus according to claim 2 wherein said vibrator housing includes a cylindrical section having a vertically extending central axis and spaced-apart prongs extending downwardly from said cylindrical section, said prongs being located close to said bottom outlet of the loader housing.

5. A bulk loader apparatus according to claim 1 wherein said vibrator includes an electric motor having a rotatable output shaft and a vibrator causing weight eccentrically mounted on said output shaft for rotation therewith, and wherein said motor is fixedly mounted to said paintball moving device.

6. A bulk loader apparatus according to claim 5 wherein said paintball moving device is a vibrator housing enclosing both said electric motor and said weight and a coil spring connected to said vibrator housing at one end thereof and connected to a top wall of said loader housing at an opposite end thereof.

7. A bulk loader apparatus according to claim 6 wherein said switch is a magnetic switch having a switch operating member that extends into said feed tube means in the absence of a paintball in said feed tube means.

8. A bulk loader apparatus according to claim 5 including a battery electrically connected to said switch and capable of powering said vibrator, said battery being mounted in a battery compartment attached to said loader housing.

9. A bulk loader apparatus according to claim 1 wherein said switch is a magnetic switch having a switch operating member that extends into said feed tube means in the absence of a paintball in said feed tube means.

10. A bulk loader apparatus according to claim 9 wherein said magnetic switch is a normally closed switch that is connected so that said vibrator is operating when the magnetic switch is closed and wherein said switch includes a compression spring biasing said switch operating member towards a position where it extends into said feed tube means.

11. A portable paintball gun apparatus comprising:

a paintball gun having an intake passage for sequentially receiving paintballs to be shot from said gun;

a loader housing for receiving and storing a quantity of paintballs and mounted generally above said gun, said loader housing having a bottom outlet through which stored paintballs may pass generally one after another;

a feed tube attached to both said loader housing at said bottom outlet and to said gun at said intake passage, said feed tube being adapted to receive and hold paintballs delivered from said housing for gravity feed into said gun;

a vibrating device mounted in or on said loader housing and capable of vibrating in order to move one or more paintballs located at or near said bottom outlet;

and a control mechanism for controlling the operation of said vibrator, said control mechanism including an electrical circuit having a sensor capable of controlling flow of current in said electrical circuit, said sensor sensing a need to operate said vibrating device to provide paintballs to said feed tube.

12. A paintball gun according to claim 11 wherein said sensor is a switch mounted in or adjacent to said feed tube for sensing the absence of a paintball within said feed tube at the location of said switch.

13. A paintball gun according to claim 12 wherein said vibrating device includes an electric motor having a rotatable output shaft and a vibration causing weight eccentrically mounted on said output shaft for rotation therewith.

14. A paintball gun according to claim 13 wherein said vibrating device further includes a vibrator housing, that encloses said electric motor and said weight, and a spring connected to said vibrator housing at one end thereof and connected to a wall of said loader housing at an opposite end thereof.

15. A paintball gun according to claim 13 wherein said electrical circuit is connected to said electric motor and is able to operate said electric motor to rotate said weight when said sensor senses said need to operate said vibrating device.

16. A paintball gun according to claim 15 wherein said electrical circuit includes a DC battery mounted on said loader housing and a manually operable on/off switch and wherein said switch includes a magnetic switch and a movable switch member having a magnet mounted thereon, said switch member being biased towards a position where said switch member extends into said feed tube.

17. A jam clearing device for a projectile loading apparatus for a gun, said device comprising;

a projectile moving device adapted for mounting in or on said loading apparatus, said device being capable of vibrating in order to move one or more projectiles located at or near an outlet of said loading apparatus;

a vibrator for causing said moving device to vibrate, said vibrator being connected to said moving device; and a control mechanism for controlling the operation of said vibrator, said control mechanism including an electrical circuit having a sensor capable of turning said vibrator on when said sensor senses a need to operate said vibrating device to feed paintballs through said outlet of the loading apparatus;

wherein during use of the jam clearing device, said electrical circuit is able to turn said vibrator off when operation of said vibrator is not required.

18. A jam clearing device according to claim 17 wherein said vibrator includes an electric motor having a rotatable output shaft and a vibration causing weight eccentrically mounted on said output shaft for rotation therewith.

19. A jam clearing device according to claim 18 wherein said projectile moving device comprises a vibrator housing, that encloses said electric motor and said weight, and a spring connected to said vibrator housing at one end and adapted for connection to a wall of said loading apparatus at an opposite end thereof.

20. A jam clearing device according to claim 19 wherein said sensor includes a magnetic switch, a movable switch member having a magnet mounted thereon, and a spring to bias said switch member during use thereof in a loading apparatus towards a position where said switch member extends into a feed passage of said loading apparatus.

21. A jam clearing device according to claim 17 wherein said sensor includes a magnetic switch, a movable switch member having a magnet mounted thereon, and a spring to bias said switch member during use thereof in a loading apparatus towards a position where said switch member extends into a feed passage of said loading apparatus.

* * * * *